United States Patent [19]

Worrall et al.

[11] Patent Number: 4,983,812

[45] Date of Patent: Jan. 8, 1991

[54] CONTROL SYSTEM FOR AN ELECTRIC COOKER

[75] Inventors: Peter W. Worrall, Ferryhill; Peter W. Crossley, Durham, both of United Kingdom

[73] Assignee: Aktiebolaget Electrolux, Stockholm, Sweden

[21] Appl. No.: 378,220

[22] PCT Filed: Oct. 31, 1988

[86] PCT No.: PCT/GB88/00937

§ 371 Date: Aug. 16, 1989

§ 102(e) Date: Aug. 16, 1989

[87] PCT Pub. No.: WO89/04543

PCT Pub. Date: May 18, 1989

[30] Foreign Application Priority Data

Nov. 3, 1987 [GB] United Kingdom ..... 8725737

[51] Int. Cl.[5] ..... H05B 3/68

[52] U.S. Cl. ..... 219/451; 219/453

[58] Field of Search ..... 219/451, 453, 448; 337/205, 206, 207; 361/179, 180; 307/116; 338/32 H

[56] References Cited

U.S. PATENT DOCUMENTS 3,711,672 1/1973 Moreland ..... 219/10.49
4,295,118 10/1981 Herr ..... 335/207

FOREIGN PATENT DOCUMENTS 3147673 8/1982 Fed. Rep. of Germany .
2089689 1/1972 France .
2374811 7/1978 France .
2556127 6/1985 France .

*Primary Examiner*—Teresa J. Walberg
*Attorney, Agent, or Firm*—Pearne, Gordon, McCoy & Granger

[57] ABSTRACT

A control system for a glass ceramic hob electric cooker having an array of magnetic field sensitive switches associated with each heater element. An actuator key, including a permanent magnet, has a planar base so that it can be moved over the array to actuate a selected one of the switches. The hob is completely free of all projections or holes and the actuator key is supported by its planar base resting on the hob.

8 Claims, 2 Drawing Sheets

CONTROL SYSTEM FOR AN ELECTRIC COOKER

The present invention relates to control systems for ceramic hob electric cookers and, more particularly, to the switch actuating mechanism for selecting various functions of the cooker.

Conventional electric cooker control system usually comprise manually operable switches or dials which are set by the user to determine which cooker elements are on and to control the temperature reached. Such mechanical controls suffer from the problem that they can be inadvertently operated giving rise to a risk that a user who comes into contact with an element that has been turned on accidentally will suffer burns. Such inadvertent operation of the controls of a cooker is a particular problem where children are present.

The present invention is for use with the type of electric cooker which has a planar, glass ceramic hob covering at least part and sometimes all the upper surface of the cooker. The electric heater elements are positioned underneath the hob. It is a considerable advantage if the hob can be completely uninterrupted by holes or projections as this enables any accidental spillages to be removed easily without any risk of contaminating other parts of the cooker. If projecting controls are provided on the glass ceramic surface then they represent regions which become difficult to clean and allow accumulation of food deposits around them. Nevertheless, there are considerable advantages in positioning the controls on the hob surface since, in such a position, they are readily accessible to the user who can quickly see what settings have been established. It is also extremely difficult to drill holes in glass ceramic material in order to allow mechanical controls to be positioned on the hob surface.

In order to overcome these technical problems the control system of the present invention uses an array of magnetic field sensitive switches.

BACKGROUND OF THE INVENTION

The concept of using an array of magnetic field sensitive switches in a control system is not, of itself, novel. A proposal has been made, for example, in DE-B-1 463 275 to use an actuating member in the shape of a tile which houses several distinct permanent magnets and which can be positioned in a recess formed in a front panel in order to select a particular control programme for a washing machine. FR-A-2 556 127 describes an entry control system which employs an array of magnetic field sensitive switches which are actuated by magnets which are received within sockets in a vertical front panel.

In such prior art systems a socket or other modification to the surface of the equipment is always employed and, as previously discussed, the construction of such recesses or sockets represents a technical problem when the surface is made of glass ceramic.

SUMMARY OF THE INVENTION

The system of the present invention solves these problems by the use of a simple actuator key that can rest on the marked surface of the hob. Such a system requires no holes in the hob, recesses or sockets of any other type. The user can be provided with a number of actuator keys which can be used as required to set the control functions of the elements of the cooker hob. When the cooker is not in use the actuator keys can be removed to a safe place thereby eliminating the risk of inadvertent operation of the controls and allowing the planar surface of the hob to be easily cleaned.

The actuator keys may be rectangular in form so that they can slide along a linear path underneath which the magnetic field sensitive switches are located. Alternatively the actuator key may be circular and rotatable with the permanent magnet being housed near the periphery so as to co-operate with an array of field-sensitive switches which are arranged around the circumference of a circle.

In a preferred embodiment feedback means are provided for giving a visual indication of which switch or switches of the array have been actuated. Such feedback may be provided by a corresponding array of LEDs positioned underneath the hob each of which illuminates when its associated switch is closed.

The magnetic field sensitive switches may be reed switches or Hall effect devices which are both readily available at reasonable prices and are reliable.

BRIEF DESCRIPTION OF THE DRAWINGS

A control system for a cooker embodying the invention will now be described, by way of example, with reference to the accompanying diagrammatic drawings, in which.

DESCRIPTION OF THE PREFERRED EMBODIMENT

Figure 1:
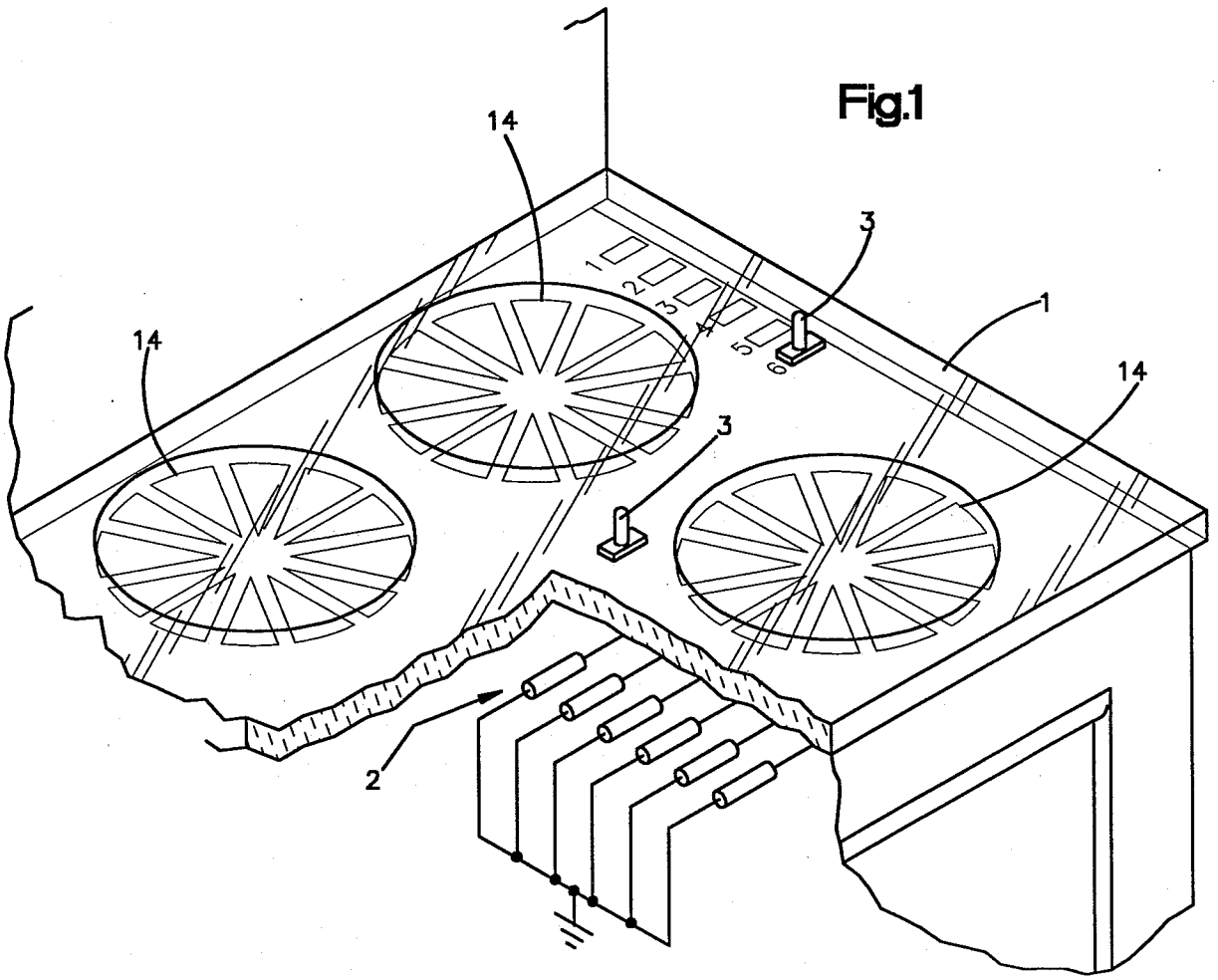
FIG. 1 is a fragmentary drawing of a cooker showing a cut-away portion of the ceramic surface to reveal diagrammatically the switch array.

Referring first to FIG. 1, the cooker hob 1 is a plate of ceramic glass below which are positioned the heating elements. On the right hand side of the hob and immediately below it, lies an array of magnetic reed switches 2, and positioned on the hob is a removable key 3 comprising a plastics moulding in the bottom of which is embedded a small ceramic magnet. This key will be further described with reference to FIG. 3.

Positioned on the surface of the hob, and immediately above the array of magnetic reed switches, is a set of markings indicating the required position of the key which will correspond to various power settings of one of the cooker elements. The required markings on the hob can be produced by screen printing using known techniques during the manufacturing process. Additionally, an array of small lamps such as the LEDs 4 shown in FIG. 2, provide an indication visible through the hot plate when any of the switches are in the closed condition.

Figure 2:
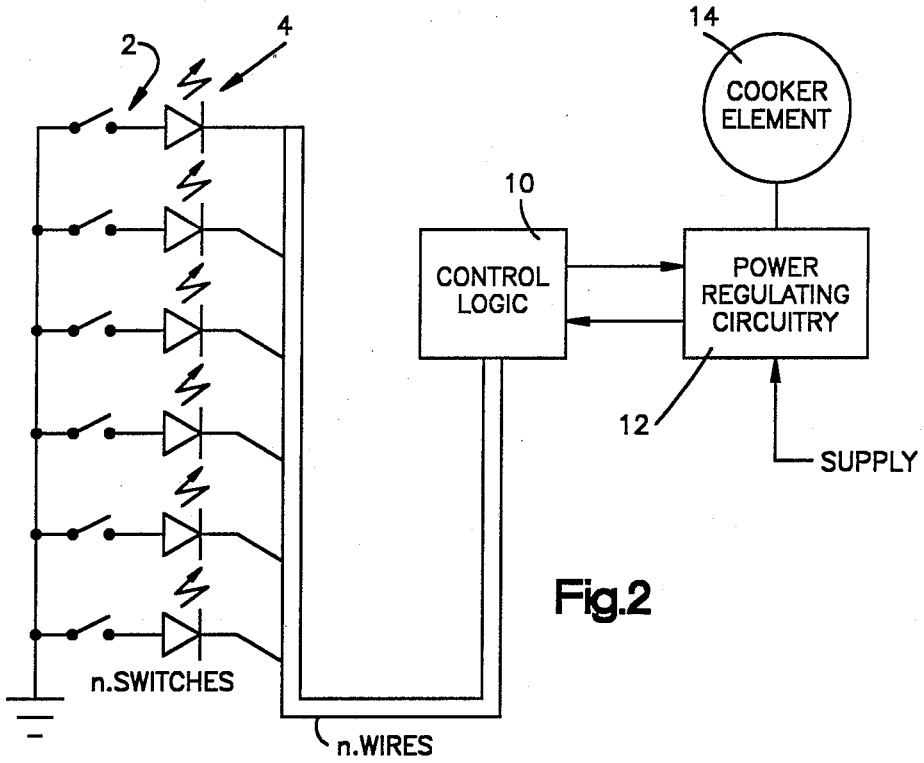
FIG. 2 is a schematic electronic circuit diagram.

Referring now to FIG. 2, one terminal of each of the switches of the magnetic reed switch array 2 is grounded and the other is connected via an LED 4 to a control logic unit 10 by an individual wire. The control logic unit applies a voltage to the switches and senses the closure of any of them. The control logic unit also provides control signals to power regulating circuitry 12.

When all the switches are open no signal is provided from the control logic unit 10 to power regulating circuitry 12, and no power is supplied by the power regulating circuitry to the associated cooker element 14 below the hob 1.

If any one of the switches 2 is now closed by application of the key 3 to the appropriate position marked on the hot plate 1, the series-connected LED 4 illuminates and the control logic senses the fact that that particular switch is closed while the others remain open, and sends an appropriate signal to the power regulating circuitry 12 to cause it to apply an appropriate power level to the associated cooker element 14. Where another display is provided to feedback information about the control status of the hob, the control logic may also be arranged to cause an appropriate indicator light on that display to light up.

As the key 3 is moved across the surface it will cause the next switch to close. Because of the hysteresis inherent in magnetic reed switches, this will usually happen before the preceding switch opens. The control logic is programmed to recognise such a condition and to select the appropriate power level (or, in other applications, program sequence). The control logic may also be programmed to recognise certain switching combinations as error conditions, and thereupon to cut-off power and/or provide an audible or visual warning.

In a modification of the cooker control system so far described, the power regulating circuitry is an electronic control circuit which accepts a temperature command signal and a temperature signal from a thermostat associated with the cooker element, and provides power to the element at a level depending on the difference between a command signal and actual temperature signal. The control logic unit 10 responds to the closure of the appropriate one of the magnetic reed switches to provide the appropriate command signal to the power regulating circuitry.

Figure 3:
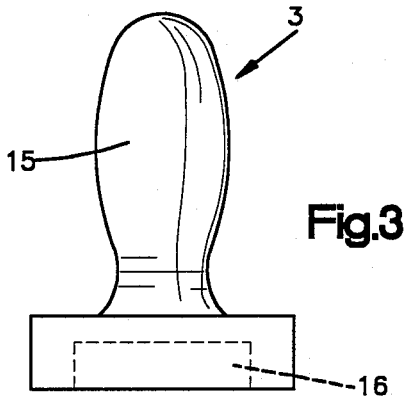
FIG. 3 shows a form of actuator key.

Referring now to FIG. 3, the key comprises a plastics molding 15 in the base of which is embedded a narrow permanent magnet 16. The size of the magnet is such that when the key is applied to the hob in the position indicated by the power level markings, the magnet will close only the reed switch situated immediately below it, causing the control logic to select an appropriate power level. Subsequent movement of the key adjacent the array causes further switches to close or open, whereupon the control logic makes corresponding changes in the power level. The base of the actuator key is flat so that it can rest in a stable position on the surface of the hob. It will, of course, be appreciated that the system is fail safe since if a key is inadvertently knocked off the hob the heater element will be switched off.

We claim:

1. A control system for an electric cooker having a planar glass ceramic hob (1) under which is disposed at least one heater element (14), the control system comprising an array (2) of magnetic field sensitive switches positioned beneath the hob (1), said heater element being de-energized when said switches are open, marking means visible from the upper surface of the hob (1) indicating the position of the switches of the array (2), and an actuator key (3) comprising a permanent magnet (16) and having a planar bottom surface which can rest on and slide over the surface of the hob (1) such that, when and only when the actuator key (3) is positioned over one of the switches of the array (2), that and only that switch is closed.

2. A control system according to claim 1, further comprising feedback means (4) for providing a visual indication of which switch is closed by the actuator key (3).

3. A control system according to claim 1, wherein each switch corresponds to a different temperature setting of the associated heater element (14).

4. A control system according to any one of the preceding claims, wherein the switches are arranged in a linear array (2).

5. A control system according to any one of claims 1, 2 or 3, wherein the switches are arranged in a circle and the actuator key (3) has an eccentrically positioned magnet (16) in its base so that rotation of the actuator key above the array actuates each of the switches in turn.

6. A control system according to any one of claims 1, 2 or 3 further comprising power regulating circuitry (12) which is thermostatically controlled, and control logic (10) which controls the thermostat setting in accordance with the state of the switches of the array.

7. A control, system according to any one of the claims 1, 2 or 3 wherein the magnetic field sensitive switches are reed switches or Hall effect devices.

8. An electric cooker comprising a control system according to claim 1, wherein said ceramic hob (1) is marked with an area for accommodating said actuator key (3) which is remote from said array (2) of magnetic field sensitive switches.

* * * * *